US006817908B2

(12) United States Patent
Freitag

(10) Patent No.: US 6,817,908 B2
(45) Date of Patent: Nov. 16, 2004

(54) TOP CLAMPING BATTERY TERMINAL CONNECTOR

(75) Inventor: Erik Freitag, Arlington Heights, IL (US)

(73) Assignee: Royal Die & Stamping Co., Inc., Bensenville, IL (US)

( * ) Notice: Subject to any disclaimer, the term of this patent is extended or adjusted under 35 U.S.C. 154(b) by 46 days.

(21) Appl. No.: 10/288,158

(22) Filed: Nov. 5, 2002

(65) Prior Publication Data

US 2004/0087219 A1 May 6, 2004

(51) Int. Cl.[7] ..... H01R 4/42
(52) U.S. Cl. ..... 439/763
(58) Field of Search ..... 439/759, 761, 439/762, 763, 764, 770, 772, 773, 774

(56) References Cited

U.S. PATENT DOCUMENTS

| | | | |
|---|---|---|---|
| 3,568,138 | A | 3/1971 | Bakker |
| 4,054,355 | A | 10/1977 | Kourimsky |
| 4,063,794 | A | 12/1977 | Dittmann |
| 4,354,726 | A | 10/1982 | Kato et al. |
| 5,316,505 | A | 5/1994 | Kipp |
| 5,599,210 | A | 2/1997 | Green |
| 5,672,442 | A | 9/1997 | Burnett |
| 5,711,688 | A | 1/1998 | Matsunaga et al. |
| 5,733,152 | A | 3/1998 | Freitag |
| 5,738,552 | A | 4/1998 | Halbach et al. |
| 5,800,219 | A | 9/1998 | Siedlik et al. |
| 5,879,202 | A | 3/1999 | Zhao |
| 5,941,738 | A | 8/1999 | Matsunaga et al. |
| 6,250,973 | B1 | 6/2001 | Lowery et al. |

*Primary Examiner*—Thanh-Tam Le
(74) *Attorney, Agent, or Firm*—Wallenstein Wagner & Rockey, Ltd.

(57) ABSTRACT

A battery terminal connector having a body portion, and an intermediate aperture for engaging a battery post. The size of the intermediate aperture is variable from a size well in excess of the diameter of the battery post to which it is to be connected, to a size somewhat smaller than the diameter of the battery post to which it is to be connected. A base plate is positioned along a line extending generally from one side surface of the connector to the other side surface of the connector. A threaded rod extends upwardly from the base plate. The connector further includes at least one vertically-movable element, including an upper and a lower wedge-shaped element. A threaded nut is preferably rotatably secured to the threaded rod. The threaded nut is positioned above and abuts against the upper of the two wedge-shaped elements. As the threaded nut is moved downward along the threaded rod, the nut pushes upon that upper wedge-shaped element. In turn, the upper wedge-shaped element forces the lower wedge-shaped element down and in. This inward movement pressures one of the side surfaces on the connector, and as a result the intermediate aperture becomes reduced in size.

9 Claims, 1 Drawing Sheet

TOP CLAMPING BATTERY TERMINAL CONNECTOR

DESCRIPTION

TECHNICAL FIELD

This invention is directed to a battery terminal connector, and more particularly to a battery connector that enables one to install the connector by tightening from the top.

BACKGROUND OF THE INVENTION

Storage batteries of the type used in automobiles, trucks and the like, generally have a terminal post made of a lead alloy material with a cylindrical or frusto-conical shape. The battery is connected to the vehicle electrical system by a battery cable assembly. The cable assembly has connectors which clamp to the battery posts, providing a secure electrical and mechanical connection.

A conventional connector for connecting cables to the battery is a molded, generally U-shaped device with a bolt passing through outwardly projecting yoke-like arms for securely clamping the connector to the battery post. The connector may also be a stamped metal battery terminal connector, fabricated from sheet metal.

U.S. Pat. No. 5,733,152 ("the '152 patent") is directed to a battery terminal connector. The '152 patent is owned by the assignee of the present application, and relates to a battery terminal connector which permits improved mechanical and electrical connection to a battery terminal post. The connector of the '152 patent has enhanced resistance to rotation when connected to a battery terminal post. That connector is also economical to manufacture, and is adaptable for automated assembly and production. An additional advantage of this connector is that it is adaptable to different automobile models and batteries.

U.S. Pat. No. 5,879,202 ("the '202 patent") is also directed to a battery terminal connector. This connector is of the type that permits it to be tightened on the battery post using a threaded nut that is positioned above, rather than on the side of, the connector. As a result, especially in tight, confining areas found under the hoods of modern automobiles, the nut is more easily accessed during installation of the '202 connector, as compared to the ease of access to threaded nuts that are secured to the sides of many prior art connectors.

Additional relevant prior art references include U.S. Pat. Nos. 6,250,973, 5,941,738, 5,879,202, 5,800,219, 5,738,552, 5,711,688, 5,672,442, 5,599,210, 5,316,505, 4,354,726, 4,063,794, 4,054,355, and 3,568,138. None of these patents, however, alone or in combination, disclose the present invention.

SUMMARY OF THE INVENTION

The invention is a battery terminal connector having a body portion. This body portion has a top, a bottom, and a pair of opposite side surfaces. The connector also includes an intermediate aperture for engaging a battery post. The size of the intermediate aperture is variable from a size well in excess of the diameter of the battery post to which it is to be connected, to a size somewhat smaller than the diameter of the battery post to which it is to be connected. In this way, the connector can accommodate its placement onto, and its removal from, the battery post.

A base plate is also included, and this base plate is positioned along a line extending generally from one side surface of the connector to the other side surface of the connector. A rod, preferably a threaded rod, extends upwardly from the base plate. The connector further includes at least one vertically-movable element. Preferably, the connector includes an upper and a lower wedge-shaped element. These elements are positioned generally along the threaded rod, and move along this threaded rod. A threaded nut is preferably rotatably secured to the threaded rod. The threaded nut is positioned above and abuts against the upper of the two wedge-shaped elements. As the threaded nut is moved downward along the threaded rod, the nut pushes upon that upper wedge-shaped element. In turn, the upper wedge-shaped element forces the lower wedge-shaped element down, and inward towards a side surface of the connector. This inward movement pressures that side surface of the connector, and as a result the intermediate aperture becomes reduced in size.

In a further embodiment, the battery terminal connector is made of copper or a copper alloy.

In a still further embodiment, the bottom of the upper wedge-shaped element is initially spaced apart from the base plate by a gap. The extent of the downward movement of the upper wedge is essentially limited to the size of the gap. In a still further embodiment, the gap is approximately one-eighth of an inch.

In yet another embodiment, the battery terminal connector is made of one piece.

DETAILED DESCRIPTION

There are many possible embodiments of this invention. The drawings and description below describe in detail a preferred embodiment of the invention. It should be understood that the present disclosure is to be considered as an example of the principles of the invention. The disclosure is not intended to limit the broad aspect of the invention to the embodiments illustrated.

Figure 1:
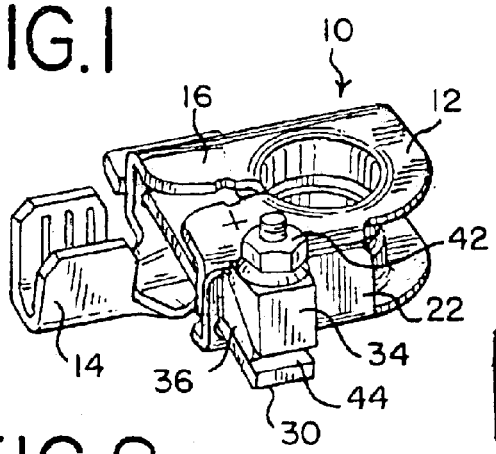
FIG. 1 is a perspective view of a first embodiment of the battery terminal connector of the present invention, and with the threaded nut in an relatively high position upon its threaded rod.

Referring to the drawings, FIG. 1 shows a perspective view of one embodiment of the battery terminal connector 10 in accordance with the invention. The connector 10 comprises essentially two main portions, including a body portion 12 and a ferrule portion 14. The battery terminal connector 10 is preferably made of copper or a copper alloy. The connector 10 is formed from a metal blank, such as a single piece of copper or sheet metal. Manufacturing the connector 10 by a stamping process as a single blank is convenient and cost-efficient.

The body portion 12 is typically fitted over a frusto-conical shaped terminal post (not shown) of a storage battery for a motor vehicle.

The ferrule portion 14 is adapted for electrically connecting and securing a battery cable (not shown) through the body portion 12 to the terminal post of the vehicular battery. The insulation-free end of the battery cable is placed onto the malleable ferrule 14. Then, the sides of the ferrule 14 are pushed towards each other so as to firmly grip, and in this way mechanically and electrically secure, the uninsulated portion of that cable to the ferrule 14.

Figure 2:
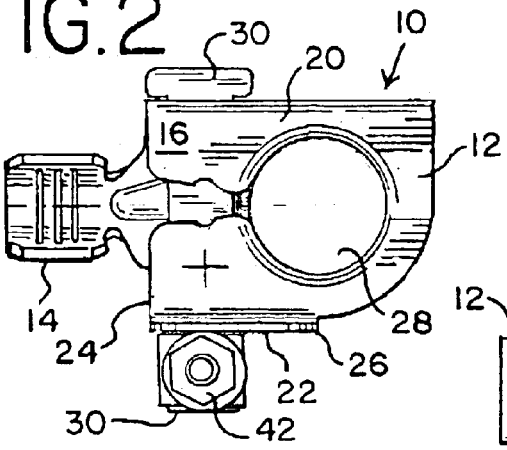
FIG. 2 is a top view of the connector of FIG. 1.
Figure 3:
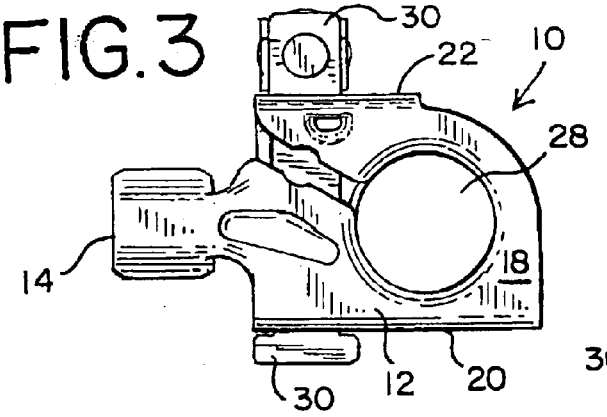
FIG. 3 is a bottom view of the connector of FIG. 1.

As shown in various Figures, the body portion 12 includes a number of surfaces. FIGS. 1 and 2 show a top surface 16, FIG. 3 shows a bottom surface 18, and FIGS. 1, 2, 3, 4, 5, and 6 show a pair of opposite side surfaces 20 and 22. As may be seen in FIG. 2, one of the side surfaces 22 is formed by a first end tab 26. As may also be seen in FIGS. 2 and 7, a second end tab 24 is provided, and this second end tab 24 is closely adjacent and abuts to the first end tab 26. In essence, these first 26 and second end tabs 24 overlap each other.

As may be seen in various Figures, including FIGS. 2 and 3, the connector 10 also includes an intermediate aperture 28 for engaging the generally frusto-conical shaped battery post (not shown). The size of the intermediate aperture 28 is variable.

FIGS. 1 and 2 show the aperture 28 in its expanded or enlarged condition. In this condition, the aperture 28 is of a size well in excess of the diameter of the battery post to which it is to be connected. The enlarged aperture 28 of FIGS. 1 and 2 enables the battery terminal connector 10 to be easily placed over the battery post.

After the battery terminal connector 10 has been placed over the battery post, it is tightened in a manner to be described later. When the connector 10 is tightened, the aperture 28 decreases in size, to the size depicted in FIGS. 6 and 7. This decreased aperture 28 size is a size somewhat smaller than the diameter of the battery post to which the connector 10 is to be connected. As a result, the connector 10 tightly grips the battery post. Because of the structure described above, the connector 10 can be easily placed onto, and removed from, the frusto-conical shaped battery post.

A base plate 30 is also provided. This base plate 30 can preferably be made of a flat piece of metal, such as steel. This base plate 30 is positioned along a line extending generally from one side surface 20 of the connector 10 to the other side surface 22 of the connector 10. In fact, however, as may best be seen in FIGS. 2 and 3, the length of the base plate 30 is greater than the distance between the two side surfaces 20 and 22.

Figure 4:
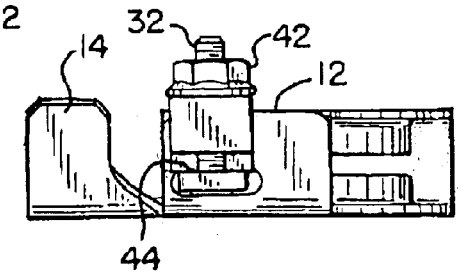
FIG. 4 is a right side view of the connector of FIG. 1.
Figure 5:
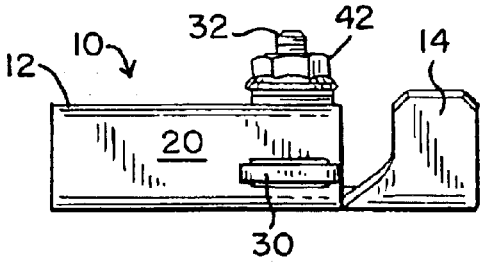
FIG. 5 is a left side view of the connector of FIG. 1.
Figure 7:
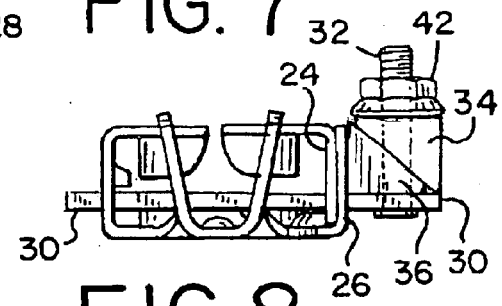
FIG. 7 is an end view, taken along the bottom of the connector, of the connector of FIG. 6.
Figure 6:
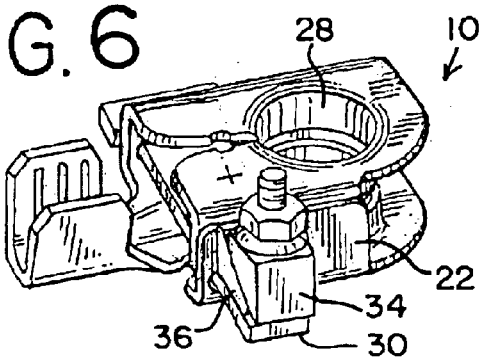
FIG. 6 is a perspective view of the battery terminal connector of FIG. 1, but with the threaded nut in a somewhat lower position upon its threaded rod.

As may best be seen in FIGS. 4, 5, and 7, a rod 32, most preferably a threaded rod, extends upwardly from the base plate 30.

The connector 10 also includes at least one vertically-movable element. These vertically-movable elements may, for example, be moved along an axis formed by the rod 32. The vertically-movable elements may be either threaded or not threaded.

In this preferred embodiment, the connector 10 includes three vertically-movable elements, one of which is threaded and the other two of which are not threaded.

Figure 8:
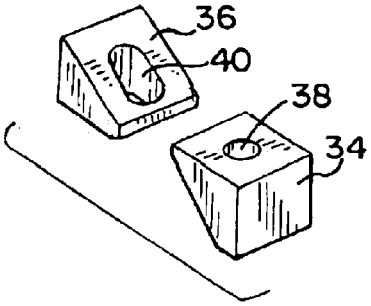
FIG. 8 is a perspective view of two wedge-shaped elements.

The non-threaded elements are an upper 34 and a lower wedge-shaped element 36. The position of these elements 34 and 36 relative to the connector 10 may best be seen in FIGS. 1, 4, 6, and 7. The elements 34 and 36 themselves may best be seen in FIG. 8. As may be seen, wedge-shaped element 34 has a generally cylindrical-shaped opening 38 that is completely contained by the various walls of the element 34. As a result, when element 34 is lowered onto rod 32, it will be retained upon that rod 32 until and unless the element 34 is lifted above the rod 32.

Wedge-shaped element 36 includes an elongated or oblong opening 40. This elongated or oblong opening 40 is also completely contained by the various walls of the element 36. As a result of this oblong construction of opening 40, wedge 36 can move both (a) vertically, up and down along the rod 32; and (b) horizontally, towards and away from the side surface 22 of battery terminal connector 10.

These wedge-shaped elements 34 and 36 are also preferably made of a rigid metal such as die-cast steel. As noted above, and as may be seen by comparing the positions of the wedge-shaped elements 34 and 36 in FIGS. 4 and 7, respectively, these elements 34 and 36 are positioned generally along the threaded rod 32, for movement along this threaded rod.

The third of the vertically-movable elements in this embodiment is a threaded element, i.e., threaded nut 42. This threaded nut 42 is rotatably secured to the threaded rod 20. This threaded nut 42 is conventional. Thus, clockwise rotation of the threaded nut 42 moves the nut downward upon the threaded rod 20, while counterclockwise rotation of the threaded nut 42 moves the nut upwardly upon the threaded rod 20.

As the threaded nut 42 is turned clockwise, it moves downwardly upon the threaded rod 32, and eventually abuts and forces down the upper wedge-shaped element 34. This, in turn, causes the upper wedge-shaped element 34 to push upon the lower wedge-shaped element 36. As noted above, the threaded nut 42, upper wedge-shaped element 34, and the lower wedge-shaped element 36 move downwardly from the initial position of FIG. 4 to the ultimate position of FIG. 7. As may be seen in FIG. 4, there is initially a space or gap 44 between the bottom of the upper wedge-shaped element 34 and the base plate 30. The extent of the downward movement of this upper wedge-shaped element 34 is essentially limited to the size of this gap 44. Most preferably, the gap 44 is approximately one-eighth of an inch.

Particularly, as the upper wedge-shaped element 34 moves down upon the threaded rod 32, the gap 44 narrows. Eventually, as shown in FIG. 7, the upper wedge-shaped element 34 contacts the base plate 30, and this gap 44 disappears. When the upper wedge-shaped element 34 reaches the base plate 30, that base plate 30 prevents further downward movement of the element 34.

As noted above, as a result of its construction, as the lower wedge-shaped element 36 moves downwardly along threaded rod 32, it also is pushed by the upper wedge-shaped element 34 in an inward, horizontal direction, i.e., towards side surface 22. As a result, first end tab 26 pushes inwardly towards second end tab 24, slowly pushing the side surface 22 towards side surface 24 and resulting in a decrease in the size of the intermediate aperture 28. The effect of this is that the slowly-closing aperture 28 begins to increasingly tightly grip the frusto-conical battery post (not shown).

Because downward movement of the lower wedge-shaped element 36 is limited by the base plate 30, the resulting inward, horizontal movement of the lower wedge-shaped element 36 is also limited. The limited inward, horizontal movement of this lower wedge-shaped element 36 prevents excessive distortion of the connector 10. If the inward, horizontal movement of this lower wedge-shaped element 36 were not limited, the side surfaces 20 and 22 could be brought together excessively, to a point where the natural "metal memory" or "springiness" of the connector 10 could be lost. If that "metal memory" were lost, the connector 10 would be less likely to open when the threaded nut 42 was returned to the position of FIG. 4, and the intermediate aperture 28 of the connector 10 would lose its tendency to spring back to its original, enlarged size, as depicted in FIGS. 1–3.

A battery terminal connector has been described which achieves good mechanical and electrical connection to the terminal post of a battery. The connector of the present invention affords easy and convenient connection and disconnection from the battery post through rotation of a standard, top-mounted fastener. Along with the remaining, described structure, this construction prevents over-torqueing of the connector, and prevents its potential resulting loss of memory.

It is understood that, given the above description of the embodiments of the invention, various modifications may be made by one skilled in the art. Such modifications are intended to be limited only by the scope of the below claims.

What is claimed is:

1. A battery terminal connector having a body portion; the body portion having a top, bottom, and a pair of opposite side surfaces, and an intermediate aperture for engaging a battery post; the size of said intermediate aperture being variable to accommodate the placement of the connector onto, and the removal of the connector from, said battery post; a base plate along a line extending generally from one side surface to the other side surface; a threaded rod extending upwardly from said base plate; an upper and a lower wedge-shaped element, said elements positioned generally along said threaded rod for movement along said threaded rod; and a threaded nut rotatably secured to said threaded rod, positioned above and abutting against the upper of said wedge-shaped elements, wherein said downward movement of said threaded nut imparts downward movement of said wedge-shaped elements; and wherein said downward movement of said wedge-shaped elements imparts pressure against one of said side surfaces so that said intermediate aperture becomes reduced in size.

2. The battery terminal connector of claim 1, wherein the said connector is made of a copper alloy.

3. The battery terminal connector of claim 1, wherein the bottom of said upper wedge-shaped element is initially spaced apart from said base plate by a gap, and wherein the extent of downward movement of said upper wedge is essentially limited to the size of said gap.

4. The battery terminal connector of claim 1, wherein said gap is approximately one-eighth of an inch.

5. The battery terminal connector of claim 1, wherein the battery terminal connector is stamped of copper.

6. The battery terminal connector of claim 1, wherein the battery terminal connector is made of one piece.

7. The battery terminal connector of claim 6, wherein the battery terminal connector is made of one piece.

8. A battery terminal connector having a body portion with a first and a second side surface, and an intermediate aperture for engaging a battery post; the size of said intermediate aperture being variable to accommodate the placement of the connector onto, and the removal of the connector from, said battery post; a base place; an upper and a lower wedge-shaped element, at least one of said elements being upwardly and downwardly movable, wherein at least one of said wedge-shaped elements imparts pressure against one of said side surfaces so that said intermediate aperture becomes reduced in size.

9. The battery terminal connector of claim 8, wherein said base plate extends along a line extending generally from one side surface to the other side surface.

* * * * *